US011792580B2

(12) United States Patent
Diehl et al.

(10) Patent No.: US 11,792,580 B2
(45) Date of Patent: Oct. 17, 2023

(54) HEARING DEVICE SYSTEM AND METHOD FOR PROCESSING AUDIO SIGNALS

(71) Applicant: Sonova AG

(72) Inventors: Peter Udo Diehl, Berlin (DE); Elias Sprengel, Berlin (DE); Manon Barbier, Berlin (DE)

(73) Assignee: Sonova AG, Staefa (CH)

( * ) Notice: Subject to any disclaimer, the term of this patent is extended or adjusted under 35 U.S.C. 154(b) by 229 days.

(21) Appl. No.: 17/182,290

(22) Filed: Feb. 23, 2021

(65) Prior Publication Data

US 2021/0281958 A1 Sep. 9, 2021

(30) Foreign Application Priority Data

Mar. 6, 2020 (EP) ..... 20161480

(51) Int. Cl.
*H04R 25/00* (2006.01)
*G10L 21/0208* (2013.01)

(52) U.S. Cl.
CPC ..... *H04R 25/507* (2013.01); *G10L 21/0208* (2013.01); *H04R 25/554* (2013.01); *H04R 25/70* (2013.01); *H04R 2420/07* (2013.01)

(58) Field of Classification Search
CPC ..... G10L 21/0208; H04R 2420/07; H04R 25/507; H04R 25/554; H04R 25/70; H04R 2499/11
USPC ..... 381/60
See application file for complete search history.

(56) References Cited

U.S. PATENT DOCUMENTS

| | | | | |
|---|---|---|---|---|
| 10,897,675 | B1 * | 1/2021 | Tsitovich | G06N 3/08 |
| 2011/0137649 | A1 | 6/2011 | Rasmussen et al. | |
| 2018/0227682 | A1 | 8/2018 | Lederman | |
| 2022/0093118 | A1 * | 3/2022 | Diehl | G06N 3/044 |
| 2022/0095061 | A1 * | 3/2022 | Diehl | G06N 3/045 |
| 2022/0256294 | A1 * | 8/2022 | Diehl | H04R 25/507 |

FOREIGN PATENT DOCUMENTS

| | | | | |
|---|---|---|---|---|
| EP | 3101919 | | 12/2016 | |
| EP | 3514792 | A1 | 7/2019 | |
| EP | 3588981 | | 1/2020 | |
| WO | WO-2020224914 | A1 * | 11/2020 | H04R 25/305 |

OTHER PUBLICATIONS

"First Examination Report received in EP Patent Application No. 20161480.7, dated Dec. 22, 2021".
European Patent Office, Searching Authority, European Search Report for EP 20 161 480, Munich, Germany.

* cited by examiner

*Primary Examiner* — Phylesha Dabney
(74) *Attorney, Agent, or Firm* — ALG Intellectual Property, LLC

(57) ABSTRACT

A hearing device (2) comprises a recording unit (5) for recording an input signal (I), an audio processing unit (6) for determining an output signal (O) and a playback unit (7) for playing back the output signal (O) to a user (U). The audio processing unit (6) comprises a neural network (8) for separating a user voice signal (u) from the input signal (I). Further, a system (1) and a method for processing audio signals are described.

20 Claims, 5 Drawing Sheets

HEARING DEVICE SYSTEM AND METHOD FOR PROCESSING AUDIO SIGNALS

CROSS-REFERENCED APPLICATION

The present application claims priority to a European Patent Application 20161480 titled "HEARING DEVICE, SYSTEM, AND METHOD FOR PROCESSING AUDIO SIGNALS," which was filed Mar. 6, 2019, and it is incorporated by reference herein for its entirety.

TECHNICAL FIELD

The present technology relates to a hearing device and to a system for processing audio signals. The present technology further relates to a method for processing audio signals.

BACKGROUND

Hearing devices as well as systems and methods for the processing of audio signals are known from prior art. For example, filtering an audio signal in a hearing device is a common technique used to optimize sound provided to a hearing device user.

SUMMARY

One object of the present technology is to improve a hearing device, in particular to provide a hearing device which processes a user voice signal with high quality and low latency.

The hearing device comprises a recording unit for recording an input signal, an audio processing unit for determining an output signal and a playback unit for playing back the output signal to the user. The inventors have realized that users of hearing devices might be alienated by an insufficient or slow processing of their own voice, especially by echoes of their own voice. According to the present technology, the audio processing unit comprises a neural network for separating a user voice signal from the input signal. Using the neural network, the user voice signal can advantageously be processed with much higher quality than by classical audio processing methods. The classical audio processing signal generally refers to analog or digital signal processing algorithms, which can be in the form of frequencies and values, e.g., as a part of a Fourier Transform.

In particular, the separation of the user voice signal from the input signal allows for processing the user voice signal independently of further sounds which might be part of the input signal. The separated user voice signal comprises low noise, preferably it is substantially noise free. Since the user voice signal is separated on the hearing device, it does not have to be transferred from an external computational device. The user voice signal is processed with low latency, minimizing, in particular avoiding, disturbing echoing of the user's own voice. The hearing device provides an improved hearing experience to the user.

Here and in the following the term "neural network" describes an artificial neural network. Complex neural networks, in particular neural networks for very general tasks, require high computational power. Due to their constructional properties, in particular their small size, hearing devices have restricted computational power and restricted battery capacity. Complex neural networks cannot be reliably executed on hearing devices. The neural network of the hearing device, however, is adapted for a very specific task, e.g., the separation of the user voice signal from the input signal. In particular, the neural network is specifically adapted to recognize the characteristics of the user's voice. Being adapted to this specific purpose, the neural network has low computational requirements and can be executed with low energy consumption. The neural network can be reliably executed on hearing devices with low computational power and low battery capacity. The neural network can generally refer to a neural network configured to be operated on a hearing device, e.g., with reduce number of layers to reduce memory size or reduced nodes adapted for computation on a hearing device. The output of the neural network can be tensor quantities that refer to outputs from nodes of a network. The tensor can be used to make a noise canceling signal to reduce noise or isolate the voice signal in an input audio signal. The hearing device or secondary device processing the two different outputs is configured to handle these two different output formats and compute values for these two different formats, simultaneously and/or separately (e.g., processes sample values in a DSP and process tensor values in a ASIC, or process both of these values together in the same processor).

The input signal corresponds to sounds, in particular ambient sounds, which have been recorded with the recording unit. In general, the input signal comprises an unknown number of different audio signals. Different audio signals might originate from different sound sources, e.g. voices, in particular conversational partners of the user, passing cars, background music and the like. The audio signals represent the sounds produced by the corresponding sound sources. In the sense of the present technology, the user voice signal may be defined as corresponding to an audio signal representation of the voice of the user of the hearing device.

The audio processing unit determines the output signal. The output signal is in particular at least partially determined, in particular at least partially generated, from the input signal. The output signal may comprise parts of the input signal, especially processed parts of the input signal. For example, the output signal might comprise the user voice signal which has been separated from the input signal. In this case, the user voice signal is played back as part of the output signal to the user with very low noise, in particular substantially noise free. This is particularly advantageous for users who cannot hear their own voice. In another example, the user voice signal which has been separated from the input signal is not part of the output signal and is not played back to the user. This might be advantageous for users who can hear their own voice. A possibly distracting echoing of the voice of the user is reliably avoided. The output signal may comprise further parts of the input signal, in particular audio signals other than the user voice signal. In particular, the output may comprise the relative complement of the user voice signal in the input signal, i.e. the rest of the input signal from which the user voice signal has been removed.

The present technology allows to determine the output signal with low latency. Preferably, the maximal latency with which the output signal is determined is 50 milliseconds or less, in particular 25 milliseconds or less, in particular 20 milliseconds or less, in particular 15 milliseconds or less, in particular 10 milliseconds or less from the recording of the input signal. Particularly preferred, the neural network is configured to separate the user voice signal from the input signal within 20 milliseconds or less, in particular within 15 milliseconds or less, in particular within 10 milliseconds or less. For example, the separation of the user voice signal from the input signal may take from about 6 milliseconds to about 7 milliseconds.

The neural network is configured to separate the user voice signal from the input signal, in particular to isolate the user voice signal. The neural network may receive the input signal as an input variable. An output of the neural network may comprise the user voice signal and/or the relative complement of the user voice signal in the input signal. Preferably the neural network returns the user voice signal, in particular only the user voice signal.

The neural network might be trained in different ways for separating the user voice signal. For example, the neural network may be trained to only recognize a specific user voice signal. In this case, the efficiency of the neural network can be optimized. However, the neural network can be specifically trained for each user. Alternatively, the neural network may be trained to identify and separate an audio signal which corresponds to a given voice characteristic. In this case, the neural network may particularly use data describing the user's voice characteristics, a so-called user's speaker embedding, to identify the user voice signal. The user's voice embedding might be an input variable for the neural network. The user's voice embedding can be static or dynamically updated to improve the operation of the neural network. Alternatively, the user's speaker embedding might be fixedly implemented in the neural network.

A hearing device in the sense of the present technology may include hearing aids, hearing implants, in particular cochlear implants and/or auditory brainstem implants, and/or hearables. Exemplary hearing aids comprise be behind-the-ear hearing aids, in-ear-hearing aids, in-canal-hearing aids, hearing glasses and/or bone-anchored hearing aids. Exemplary hearables comprise smart headphones.

According to one preferred aspect of the present technology, the audio processing unit further comprises a classical audio signal processing means for processing at least parts of the input signal, in particular for denoising at least parts of the input signal. Denoising generally means remove noise or unwanted sounds from a signal to provide clean or denoised signal to user. In some implementations, denoising can be referred to as "clean-up" or "sound enhancement" as it is a process that removing or masking parts of a signal that are undesired. In the sense of the present technology, classical audio signal processing means comprise all audio signal processing means, in particular computational means for audio processing, which do not use neural networks. The classical audio signal processing means may comprise analogous and/or digital, in particular software-based, methods of audio processing. The classical audio signal processing for hearing device can include applying or using a gain model and frequency translation or shifting. For example, the output signal may comprise the classically processed, in particular denoised parts of the input signal which do not correspond to the user voice signal. Alternatively, the classical audio signal processing means may be used to process, in particular denoise, the entire input signal, e.g., potentially including the user voice signal.

According to a further preferred aspect of the present technology, the classical audio signal processing means and the neural network are configured to be run in parallel and/or in series. In particular, the classical audio signal processing means and the neural network can be configured to parallelly process the input signal. This allows for a particularly efficient and fast processing of the input signal. The output signal may comprise the classically processed, in particular denoised, input signal and/or the separated user voice signal. In some implementations, the present technology can switch between classical audio signal processing means and neural network means, e.g., depending on if the one processing method causes too long of delay or provides a poor sound quality or signal-to-noise (SNR) ratio compared to other. Classical digital signal processing methods may also include beamforming or opening or closing a vent (e.g., active vent) of the hearing device.

Alternatively, the neural network and the classical audio signal processing means may be executed in series. In other words, the classical audio signal processing means and the neural network are subsequently applied to the input signal or parts thereof. Preferably, the neural network is first applied to separate the user voice signal from the input signal. The classical audio signal processing means can be applied in a second stage in order to process, in particular denoise, at least part of the input signal. Advantageously, the classical audio signal processing means can be applied to parts of the input signal which do not contain the user voice signal, in particular the relative complement of the user voice signal in the input signal. In particular, all parts of the input signal which do not correspond to the user voice signal can be denoised using the classical audio signal processing means. This allows for a more elaborate audio processing by the audio processing unit.

Subsequently executing the neural network and the classical audio signal processing means has the further advantage that a processed, in particular denoised, output signal can be generated which does not contain the user voice signal. This might be particularly advantageous for user who do not require their own voice to be played back to them.

Preferably, the audio processing unit is adapted to execute the classical audio signal processing means and the neural network in parallel and in series. Even more preferred, the audio processing means is adapted to switch between a parallel execution and a subsequent execution of the neural network and the classical audio signal processing means, depending on requirements. For example, in conditions where the input signal does not contain a lot of noise, e.g. when the user talks to another person in an otherwise silent surrounding, a parallel execution of the neural network and the classical audio signal processing means might be preferred due to its efficiency. Alternatively, in more complex situations, e.g. if there is a lot of noise, the audio processing unit may switch to running the neural network and the classical audio signal processing means in series.

The neural network can have different network architectures. Preferably, the neural network is a long short-term memory (LSTM) network. LSTM networks are particularly suitable to separate single audio signals, in particular user voice signals, form more complex input signals. The separation is performed with high quality and high efficiency.

According to a further preferred aspect of the present technology, the neural network is configured as a long short-term memory (LSTM) network with three layers. Preferably, the LSTM network comprises 512 units or less per layer, in particular 300 units or less per layer, in particular 256 units or less per layer. The neural network has low computational needs and can be run with low energy consumption. The hearing device may have a long runtime on a single battery charge. The neural network may be run on arithmetic units which are conventionally used in audio processing units of hearing devices.

Preferably, the audio processing unit comprises a specifically adapted arithmetic unit in form of a so-called AI-chip. Due to the low computational needs of the neural network, an exemplary AI-chip may have a computing power of 100 megaflop, in particular 1 gigaflop, in particular 2 giga-flop, preferably 4 gigaflops. Also, a computing power of more than 4 gigaflop is possible. The audio processing unit may in particular comprise an application-specific integrated circuit (ASIC) to execute the neural network. The ASIC may be optimally adapted to execute the neural network. The neural network can be run particularly efficient. In some implementations, the neural network comprises a deep neural network that is located on an external mobile computing device (relative to the hearing device) and in other implementations the deep neural network may be distributed among the external device and the hearing device. For example, part or all of the neural network may reside in a wireless microphone that is configured to wirelessly communicate with the hearing device. The neural network can also be located entirely on the hearing device.

According to a further preferred aspect of the present technology the hearing device comprises a sensor for measuring a presence of the user voice signal in the input signal. In particular, if the hearing device is worn close to the ears and/or the mouth of the user, sensor data might be used in post or preprocessing of the input signal to measure, in particular verify, a presence of the user voice signal. The sensor may for example detect vibrations in speech or increased loudness in the input signal which stems from the user's voice. The sensor can be a voice detection unit, e.g., a software module in the hearing device memory that can used a processor digital signal processor to determine a voice signal. Preferably, the sensor might be a vibration sensor. Alternatively, or additionally, the hearing device can comprise another sensor such as a PPG, EEG, EOG, ECR, accelerometer, or temperature sensor.

The sensor data can preferably be used to adapt the mode of operation for processing the input signal. For example, if the sensors, especially the vibration sensor, does not measure the presence of the user voice signal in the input signal, the neural network can be temporarily deactivated. The efficiency of the audio processing by the audio processing unit is increased, the power consumption is reduced. The neural network can be reactivated as soon as the sensors measure the presence of the user voice signal in the input signal. This can, for example, be achieved by measuring vibrations caused by the user's speech.

A further object of the present technology is to improve systems for processing audio signals. This object is achieved by a system for processing audio signals with the features of claim 6. The systems comprise at least one hearing device as it has been described above. The system further comprises a secondary device. The secondary device comprises a secondary audio processing unit for determining a secondary output signal, wherein the secondary audio processing unit comprises at least one secondary neural network for processing, in particular denoising, at least parts of a secondary input signal. The secondary device is in data connection with the at least one hearing device for transmitting at least parts of the secondary output signal to the at least one hearing device and/or to receive the secondary input signal from the at least one hearing device.

The at least one hearing device is configured as described above, e.g., it comprises an audio processing unit with a neural network for separating a user voice signal from the input signal. Hence, the system with the at least one hearing device offers the same technical advantage in that the user voice signal can be reliably processed with high quality and low latency. The secondary device further improves the audio signal processing. The secondary audio processing unit with the at least one secondary neural network allows to use more elaborated and demanding audio processing, in particular denoising algorithms. In particular, the secondary audio processing unit of the secondary device allows for high quality audio signal processing with the neural networks for general audio signals, not limited to the user voice signal.

The system allows for a functional separation of different aspects of the audio signal processing. The user voice signal is separated from the input signal directly on the hearing device using the neural network. This way a low latency, which is significant for the user voice signal, is guaranteed while other aspects of the audio signal processing can be outsourced to the secondary device. Distracting delays and/or echo effects of the user voice signal are consequently avoided. At the same time, high quality audio processing can be performed on the secondary device. In particular, audio signals other than the user voice signal can be processed, in particular denoised, on the secondary device. For audio signals other than the user voice signal, an increased latency is less crucial than for the user voice signal, in particular because other audio signals are less prone to cause disturbing echoing effects than the user voice signal.

The secondary audio processing unit may comprise one or more secondary neural networks. Different secondary neural networks may be adapted to process, in particular denoise different kinds of audio signals, for example human voices, traffic noise or the like. The secondary audio processing unit may run several neural networks in parallel in order to process, in particular denoise, different audio signals. Further, the secondary audio processing unit may choose from a larger set of secondary neural networks one or more secondary neural networks which are best adapted to process the current secondary input signal.

The secondary device and the at least one hearing device are in data connection with each other, in particular, in wireless data connection. Particularly suitable are BLUETOOTH connections or similar protocols like FM-transmitters, aptX LL and/or nearfield magnetic induction. The at least one hearing device and the secondary device may comprise data interfaces to establish at least one of the above-specified data connections. The secondary device can also use a proprietary protocol like ROGER from PHONAK, which has a lower latency for audio signals than BLUETOOTH.

Except for the transfer of data via the data connection, the at least one hearing device and the secondary device preferably are independent from each other. Preferably, the at least one hearing device and the secondary device each comprise own computational means and/or own power supplies, in particular, own batteries. Due to the size of the at least one hearing device, its computational power and power supply are rather limited. Such limitations do not apply to the at least one secondary device. Hence, the secondary device can perform more demanding calculations. In particular, the secondary device can execute more elaborate secondary neural networks.

The system may comprise one or more hearing devices, preferably two hearing devices. The at least one hearing device may comprise one or more of the above-described optional features. In case that the system comprises more than one hearing device, each hearing device preferably can be operated independently of the other hearing devices. In particular, each hearing device can record its own input signal and determine its own output signal. Due to different positions in space, each hearing device can record slightly different input signals.

The secondary input signal can be recorded by the at least one hearing device and transferred to the secondary device via the data connection. Preferably, the secondary device directly records the secondary input signal.

The secondary output signal can be transferred to the at least one hearing device. The secondary output signal can comprise audio data, in particular parts of the processed secondary input signal. Audio data, which is transferred to the at least one hearing device with the secondary output signal, can be added to the output signal and be played back to the user. In this regard, the determination of the output signal by the audio processing unit of the at least one hearing device may include combining at least parts of the secondary output signal with further audio signals processed on the at least one hearing device, in particular the user voice signal.

Alternatively or additionally, the secondary output signal can comprise analysis data obtained by the processing of the secondary input signal via the at least one secondary neural network. Using the analysis data, the audio processing of the at least one hearing device may be altered, in particular adapted to the input signal. For example, depending on the analysis of the secondary input signal, the neural network of the audio processing unit of the at least one hearing device may be temporarily deactivated. For example, the neural network may be temporarily deactivated if the analysis data finds that a separation of the user voice signal is not needed, e.g. when the secondary input signal does not contain a lot of noise.

According to a further preferred aspect of the present technology, the secondary device further comprises a secondary recording unit for recording the secondary input signal. The secondary input signal does not have to be transferred from the at least one hearing device to the secondary device. The speed of the audio processing is increased. The secondary recording unit may comprise one or more microphones, in particular at least two microphones. Using two or more microphones, spatial information of the secondary input signal can be recorded. The spatial information may be used in pre- or post-processing of the secondary input signal.

According to a further preferred aspect of the present technology, the at least one secondary neural network is configured to separate the user voice signal from the secondary input signal. Preferably, the secondary neural network filters noise and the user voice signal from the secondary input signal. In particular, the user voice signal is removed from the secondary input signal before further processing. The output of the secondary neural network preferably only contains audio signals other than the user voice signal.

Preferably, the secondary neural network removes the user voice signal and noise from the secondary input signal. For example, the secondary neural network removes the user voice signal from the secondary input signal before denoising the remaining parts of the secondary input signal. The secondary output signal may comprise improved, in particular noise-free, audio signals not containing the user's voice. This is advantageous if the secondary output signal forms part of the output signal played back to the user. In this case, a distracting echoing of the user's voice is reliably avoided.

According to a further preferred aspect of the present technology, the secondary audio processing unit comprises a calibration neural network for calibrating the neural network and/or the secondary neural network. For example, the calibration neural network may be configured for training the neural network and/or the secondary neural network, in particular for training in recognizing the user's voice. Additionally or alternatively, the calibration neural network may calculate the user's speaker embedding containing the voice characteristics of the user. Particularly preferable, the user's speaker embedding is created and sent to the at least one hearing device once, in particular when the hearing device is used for the first time by the user. The system, in particular the neural network of the at least one hearing device and/or the secondary neural network of the secondary device, can be calibrated for a specific user without the need of further hardware, in particular without the user needing to seek professional assistance, e.g. by an audio engineer or by a clinic.

Preferably, the calibration neural network analyzes a calibration input signal, in particular containing samples of the user's voice. In particular, the calibration input signal can be recorded by the recording unit of the at least one hearing device and/or by a secondary recording unit of the secondary device. Preferably, the calibration input signal comprises Mel Frequency Cepstral Coefficients (MFCC) as well as two derivatives thereof.

According to a further preferred aspect of the present technology the secondary device is a mobile device, in particular a mobile phone, preferably a smart phone. Mobile devices, e.g. tablets, laptops, smart watches or mobile phones, provide high computational power and high battery capacity. Providing the secondary device in form of a mobile device, in particular in form a mobile phone, has the further advantage that the secondary device is realized in hardware which is anyway carried by the user. Additional devices are not needed.

According to a further advantageous aspect of the present technology, the calibration device is in the form of a of a wireless microphone. Wireless microphones are assistive listening devices used by hearing impaired persons to improve understanding of speech in noise and over distance, such as the ROGER SELECT microphone manufactured by PHONAK AG. Wireless microphones can be equipped with sufficient computing power as needed for running a neural network, possibly using a coprocessor dedicated to the neural network execution. This allows independent operation of the hearing device system, in particular even for computationally complex operations by the calibration device. Moreover, this has the advantage that the hearing device system is realizable by hardware that a user carries anyway. Additional devices are not necessary. It is furthermore advantageous that the user, owing to the functional split according to the present technology, can use the computing power of the mobile phone for other activities completely without the signal processing by the at least one hearing device being limited.

Preferably, the components of the secondary device, in particular the secondary audio processing unit, are realized by the hardware of the mobile device, in particular the mobile phone. For example, the secondary recording unit may be realized by the microphones of the mobile phone. Preferably, the secondary audio processing unit may be realized by a specific software, in particular a specific app, which is run on the mobile device. The software may comprise the at least one secondary neural network and/or the calibration neural network and/or other audio processing routines.

Preferably, the system is modular. The system can be flexibly adapted. Individual components of the system can be exchanged and/or updated. For example, the user can buy a new mobile phone onto which a specific software, in particular an app, is installed which provides the functionality of the secondary device.

The secondary device, in particular in form of a mobile device, may comprise secondary device sensors for collecting user data, in particular the position and/or movement of the user, e.g. a GPS sensor. Such user information can be used in pre- or post-processing of the secondary input signal by the secondary audio processing unit. For example, the secondary device can determine the position of the user and adapt the processing of the secondary input signal. In particular, the secondary device can choose a secondary neural network which is specifically adapted to the surroundings of the user.

The secondary device may further comprise a user interface, e.g. in form of a touch screen. Via the user interface, the user can set preferences for the audio processing. For example, the user can set the degree of denoising and/or the amplification of the output signal. The user can also switch be-tween different modes of operation of the system. Preferably, the user can set default settings using the user interface.

Different network architectures can be used for the secondary neural network and/or the calibration neural network. Preferably the secondary neural network and/or the calibration neural network can be provided as a long short-term memory (LSTM) network. An exemplary secondary neural network is a LSTM network with four layers. Each of the layers preferably has 128 units or more, in particular 256 units or more, in particular 300 units or more. An exemplary calibration neural network can be provided as a LSTM network with three layers. Each layer preferably may have 128 units or more, in particular 256 units or more.

The secondary neural network and the calibration neural network can be run on the same arithmetic unit, in particular the same AI-chip of the secondary audio processing unit. Preferably, the secondary neural network and the calibration neural network are executed on different arithmetic units of the secondary audio processing unit.

It is another object of the present technology to improve a method for processing audio signals. In a first step, at least one hearing device as described above is provided. The at least one hearing device may comprise one or more of the above-described optional features. In further steps, an input signal is recorded using the recording unit of the at least one hearing device. An output signal is determined using the audio processing unit, wherein a user voice signal is separated from the input signal by the neural network. The output signal is played back to the user using the playback unit of the at least one hearing device. The advantages of the method coincide with the advantages of the above-described hearing device.

The steps of recording the input signal, determining the output signal and playing back the output signal may be performed subsequently. Preferably, however, the steps are performed continuously during operation of the at least one hearing device. This means that the recording unit constantly records an input signal. The audio processing unit then processes recorded parts of the input signal. The determined output signal is then being played back to the user in form of a continuous audio stream.

According to one preferred aspect of the method, determining the output signal comprises processing, in particular denoising, at least parts of the input signal by classical audio signal processing means. The classical audio signal processing means may process, in particular denoise, the complete input signal. Alternatively, the classical audio signal processing means process, in particular denoise, parts of the input signal, preferably audio signals other than the user voice signal, in particular the relative complement of the user voice signal in the input signal. For example, the user voice signal which has been separated by the neural network can be subtracted from the input signal before further processing.

According to a further preferred aspect of the method, the input signal is processed, in particular denoised, by the classical audio signal processing means in parallel to the separation of the user voice signal by the neural network. In particular, the complete input signal can be processed, preferably denoised, in parallel to the separation of the user voice signal. This mode of operation leads to a particularly fast determination of the output signal.

According to a further preferred aspect of the method, the input signal is processed, in particular denoised, by the classical audio signal processing means after the user voice signal is separated from the input signal by the neural network. The classical processing, in particular denoising, by the classical audio signal processing means can be applied to the entire input signal. Preferably, the classical audio signal processing means process, in particular denoise, the parts of the input signal which do not correspond to the user voice signal. For determining the output signal, the classically denoised parts of the input signal can be combined with the user voice signal which has been separated from the input signal using the neural network. Alternatively, the output signal can only contain the user voice signal or the classically processed, in particular denoised, parts of the input signal which do not correspond to the user voice signal.

According to a further preferred aspect of the method, determining the output signal comprises pre- and/or post-processing the input signal, in particular for measuring a presence of the user voice signal in the input signal. Post-processing of the input signal may comprise combining different audio signals, e.g. the user voice signal with further parts of the input signal other than the user voice signal. Post-processing may comprise amplifying different audio signals, e.g. to adapt their relative loudness in the output signal. The output signal advantageously is adaptable to ensure optimal hearing experience.

Preprocessing of the input signal may comprise classical pre-processing routines, for example for enhancing the quality of the input signal. Pre- and post-processing of the input signal preferably comprises measuring the presence of the user voice signal in the input signal, in particular verifying whether the user voice signal is part of the input signal or not. Preferably, the presence of the user voice signal is measured in pre-processing. Advantageously, this information can be used to adapt the audio processing, in particular to choose between different operation modes of the audio processing unit. For example, when the pre-processing does not measure the presence of the user voice signal in the input signal, the neural network of the audio processing unit may be temporarily deactivated. This decreases computational needs for determining the output signal. Alternatively, when the presence of the user voice signal is measured, the neural network can be activated, in particular reactivated, in order to ensure reliable separation and processing of the user voice signal.

The measurement of the presence of the user voice signal in the input signal preferably makes use of the fact that the hearing device normally is carried close to the ears and/or the mouth of the user. The presence of the user voice signal may, for example, be measured by an increased loudness in the input signal. Another possibility would be to use sensor data, in particular vibration sensor data, to verify whether the user is speaking or not.

According to a further preferred aspect of the method, a secondary device is provided. The provided secondary device comprises a secondary audio processing unit for determining the secondary output signal, wherein the secondary audio processing unit comprises at least one secondary neural network for processing, in particular denoising, at least parts of the secondary input signal. The provided secondary device is in data connection with the at least one hearing device. A secondary input signal is provided to the secondary device. Using the secondary audio processing unit a secondary output signal is determined, wherein at least parts of the secondary input signal are processed, in particular denoised, using the secondary neural network. At least parts of the secondary output signal are transmitted to the at least one hearing device.

Preferably, the secondary device is provided together with the at least one hearing device. The provided secondary device may comprise one or more of the features which have been described above in respect to the system for audio processing.

The secondary input signal can, for example, be provided to the secondary device by being transferred from the at least one hearing device to the secondary device. For example, the secondary input signal may coincide with the input signal which is recorded by the recording unit of the at least one hearing device. Preferably, the secondary input signal may be recorded by a secondary recording unit of the secondary device. A transmission of the secondary input signal from the at least one hearing device is avoided. This way, the latency in determining the secondary output signal may be decreased.

According to a further preferred aspect of the method, the processing of the secondary input signal by the at least one secondary neural network comprises separating the user voice signal from the secondary input signal.

Preferably, the secondary neural network removes, the user voice signal from the secondary input signal. The secondary neural network preferably filters the user voice signal and noise from the secondary input signal. In particular, the secondary neural network returns improved, in particular noise-free, audio signals other than the user voice signal.

According to a further preferred aspect of the method, the secondary output signal is at least partially included in the output signal by the audio processing unit of the at least one hearing device. Determining the output signal by the audio processing unit of the at least one hearing device may include combining at least parts of the secondary output signal with further audio signals processed on the at least one hearing device, in particular the user voice signal.

According to a further preferred aspect of the present technology, the method further comprises calibrating the neural network and/or the secondary neural network using a calibration neural network being part of the secondary audio processing unit. Calibration is preferably performed once when the user is starting to use the at least one hearing device. Preferably, the calibration neural network may calculate the user's speaker embedding containing the voice characteristics of the user. Particularly preferable, the user's speaker embedding is created and sent to the at least one hearing device once, in particular when the hearing device is used for the first time by the user. The system, in particular the neural network of the at least one hearing device and/or the secondary neural network of the secondary device, can be calibrated for a specific user without the need of further hardware, in particular without the user needing to seek professional assistance, e.g. by an audio engineer or by a clinic.

According to a further preferred aspect of the method, a calibration input signal is provided to and analyzed by the calibration neural network. The calibration input signal may be provided to the calibration neural network by transferring the calibration input signal to the secondary device. For example, the calibration input signal can be recorded by the recording unit of the at least one hearing device and transmitted to the secondary device via the data connection. Alternatively, the calibration input signal may be recorded by a secondary recording unit of the secondary device. Preferably the calibration input signal is recorded for a given amount of time, e.g. between 5 seconds and 30 minutes, in particular between 30 seconds and 15 minutes, in particular between 1 minute and 10 minutes, in particular between 2 minutes and 5 minutes, for example for about 3 minutes. The longer time the calibration input signal is recorded, the more samples of the user voice are provided to the calibration neural network and the more precise the calibration becomes.

The calibration signal preferably contains samples of the user's voice. For example, the calibration signal can contain samples of the user speaking, in particular reading a given text. Preferably, the calibration input signal contains Mel Frequency Cepstral Coefficients and two derivatives thereof.

Further details, advantages and features of the present technology emerge from the description of an illustrative embodiment with reference to the figures.

DETAILED DESCRIPTION

Figure 1:
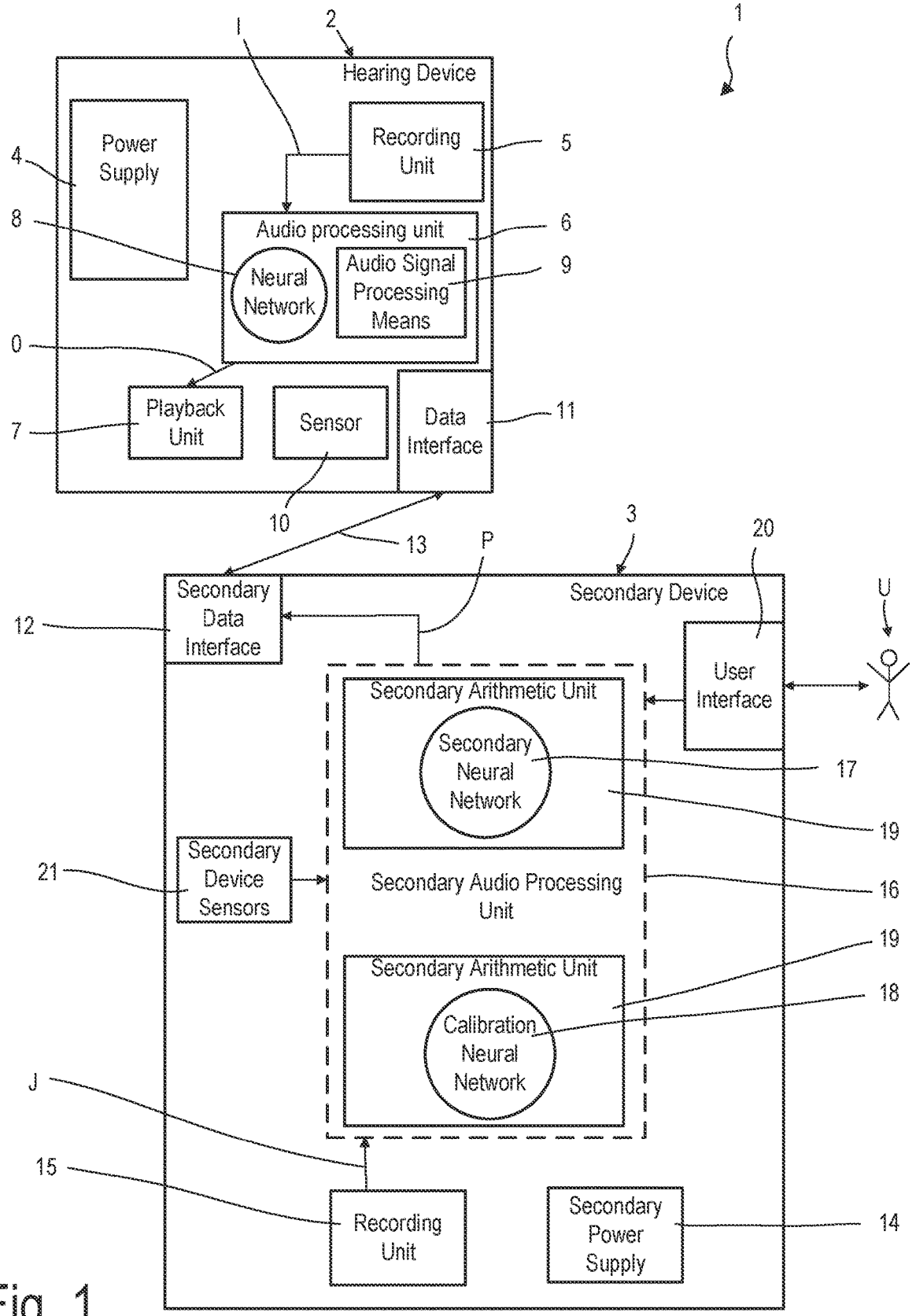
FIG. 1 shows a schematic representation of a system for processing audio signals comprising a hearing device and a secondary device.

FIG. 1 shows a schematic representation of a system 1 for processing audio signals. The system 1 comprises a hearing device 2 and a secondary device 3. In the shown embodiment, the hearing device 2 is a hearing aid. In other embodiments, the hearing device may be a hearing implant, for example a Cochlea implant, or a hearable, e.g. a smart headphone. In the shown embodiment, the secondary device 3 is a mobile phone, in particular a smart phone.

The hearing device 2 comprises a power supply 4 in form of a battery. The hearing device comprises a recording unit 5, an audio processing unit 6 and a playback unit 7. The recording unit 5 is configured to record an input signal I. The input signal I corresponds to sound, in particular ambient sound, which has been recorded with the recording unit 5. The audio processing unit 6 is configured to determine an output signal O. The playback unit 7 is configured to play back the output signal O to a user U.

The audio processing unit 6 comprises a neural network 8 and a classical audio signal processing means 9. The neural network 8 is an artificial neural network. The classical audio signal processing means 9 comprise computational means for audio processing which do not use a neural network. The classical audio signal processing means 9 can, for example, coincide with audio processing means used in known hearing aids such as digital signal processing algorithms carried about in a digital signal processor (DSP). The audio processing unit 6 is configured as an arithmetic unit on which the neural network 8 and/or the classical audio signal processing means 9 can be executed.

The neural network 8 is configured to separate a user voice signal u (e.g., FIGS. 3 to 6) from the input signal I. The user voice signal u corresponds to an audio signal representation of the voice of a user U of the hearing device 2. When the voice of the user U is recorded by the recording unit 5, the input signal I contains the user voice signal u. The neural network is trained to identify and separate an audio signal corresponding to a voice with specific voice characteristics. In order to identify the correct voice, the neural network receives a user's speaker embedding together with the input signal I as input variables. The user's speaker embedding is data describing the user's voice characteristics. The neural network 8 separates the user voice signal u from the input signal and returns the user voice signal u as an output variable. If no user voice signal u is contained in the input signal I, the output of the neural network 8 is empty. In alternative embodiments, the neural network 8 is specifically trained to identify and separate only the user's voice. In such embodiments the user's speaker embedding is not needed.

The neural network 8 is highly specialized. It can be run efficiently with low computational requirements. Further, running the neural network 8 does not require high energy consumption. The neural network 8 can be reliably run on the hearing device 2 for long times on a single charge of the power supply 4. The neural network 8 can have any suitable architecture for neural net-works. An exemplary neural network 8 is a long short-term memory (LSTM) network with three layers. In an exemplary embodiment, each layer has 256 units.

The hearing device 2 comprises a sensor 10. The sensor 10 is a vibration sensor. The sensor 10 detects vibrations caused by the user U speaking. The sensor 10 can be used to measure a presence of the user voice signal u in the input signal I.

The hearing device 2 comprises a data interface 11. The secondary device 3 comprises a secondary data interface 12. The hearing device 2 and the secondary device 3 are connected via a wireless data connection 13, e.g., via a standard BLUETOOTH wireless data connection or via a wireless data connection implemented with a proprietary protocol such as the ROGER protocol or such as a proprietary protocol implemented via modifying the BLUETOOTH protocol. Proprietary protocol, such as ROGER, can present the advantage of permitting to reach a lower audio delay than the audio delay than can be achieved with standard protocols.

The secondary device 3 comprises a secondary power supply 14. The secondary device 3 comprises a secondary recording unit 15 and a secondary audio processing unit 16. The secondary recording unit 15 comprises one or more microphones to record a secondary input signal J. The secondary input signal J corresponds to sounds, in particular ambient sounds, which have been recorded with the secondary recording unit. Many modern mobile phones comprise several microphones which may be used by the secondary recording unit. Using several microphones, spatial information about the secondary input signal J. Further, the secondary input signal J can be recorded in stereo.

The secondary audio processing unit 16 is configured to determine a secondary output signal P. The secondary output signal P is determined based on the secondary input signal J. The secondary audio processing unit 16 comprises a secondary neural network 17. The secondary neural network 17 is configured to separate the user voice signal u from the secondary input signal J. To this end, the secondary neural network 17 uses the same user's speaker embedding as the neural network 8. In contrast to the neural network 8, the secondary neural network 17 does not return the user voice signal u, but the remaining audio signals contained in the secondary input signal J which do not correspond to the user voice signal u. The secondary neural network 17 removes the user voice signal u from the secondary input signal J. In other words, the secondary neural network 17 calculates the relative complement the user voice signal u in the secondary input signal J, i.e. J−u. The secondary neural network 17 is further configured to denoise the secondary input signal J. In other words, the secondary neural network filters noise and the user voice signal u from the secondary input signal J. The output of the secondary neural network 17 hence is the denoised relative complement of the user voice signal u, i.e. a denoised version of the audio signals (J−u). The secondary output signal P comprises the output of the secondary neural network 17.

The secondary neural network 17 can perform more advanced operations on the secondary input signal J than the neural network 8 performs on the input signal I. Hence, the secondary neural network 17 requires more computational power. This is possible, because the secondary device 3 does not have comparable constraints concerning computational capabilities and capacity of the power supply as the hearing device 2. Hence, the secondary device 3 is able to run the more complex secondary neural network 17.

Any suitable network architecture can be used for the secondary neural network 17. An exemplary secondary neural network is a long short-term memory (LSTM) network with four layers. Per layer, the secondary neural network may comprise 300 units. In other embodiments, the secondary audio processing unit 16 may comprise more than one secondary neural networks 17. In these embodiments, different of the secondary neural networks 17 may be specialized for different purposes. For example, one of the secondary neural networks 17 may be configured to remove the user voice signal u from the secondary input signal J. One or more different secondary neural networks may be specialized for denoising specific kinds of audio signals, for example voices, music and/or traffic noise.

The secondary audio processing unit 16 further comprises a calibration neural network 18. The calibration neural network is configured to calibrate the neural network 8 and the secondary neural network 17. The calibration neural network 18 calculates the user's speaker embedding needed identify the user voice signal. To this end, the calibration neural network 18 receives a calibration input signal containing information about the user's voice characteristics. In particular, the calibration neural network 18 uses Mel Frequency Cepstral Coefficients (MFCC) as well as two derivatives therefrom of examples of a user's voice. The calibration neural network 18 returns the user's speaker embedding, used as input variable in the neural network 8 as well as the secondary neural network 17.

Any suitable architecture can be used for the calibration neural network 18. An exemplary calibration neural network 18 is a long short-term memory (LSTM) network with three layers and 256 units per layer.

The secondary neural network 17 and the calibration neural network 18 are run on the secondary audio processing unit 16. In the shown embodiment, the secondary audio processing unit 16 comprises two secondary arithmetic units 19, on which the secondary neural network 17 and the calibration neural network 18 can be run respectively. In the shown embodiment, the secondary arithmetic units 19 are AI-chips of the secondary device 3. In alternative embodiments, the secondary neural network 17 and the calibration neural network 19 can be run on the same arithmetic unit. In such embodiments, the secondary audio processing unit 16 can be comprised of a single arithmetic unit.

The secondary device 3 further comprises a user interface 20. The user interface 20 of the secondary device is a touchscreen of the mobile phone. Via the user interface 20, information about the audio processing on the hearing device 2 and the secondary device 3 is submitted to the user U. Further, the user U can influence the audio processing, e.g. by setting preferences and changing operation modes. For example, the user U can set the degree of denoising and/or the amplification of the output signal.

The secondary device 3 comprises secondary device sensors 21. The secondary device sensors 21 collect user data. The audio processing can be adapted based on the user data. For example, the audio processing can be adapted to position and/or movement of the user. In embodiments with several neural networks 17, the user data can, for example, be used to select one or more of the secondary neural networks 17 which are best adapted to the surroundings of the user U.

In the shown embodiment, the hardware of the secondary device 3 is the usual hardware of a modern mobile phone. The functionality of the secondary device 3, in particular the functionality of the secondary audio processing unit 16, is provided by software, in particular an app, which is installed on the mobile phone. The software comprises the secondary neural network 17 as well as the calibration neural network 19. Further, the software provides a program surface displayed to the user U via the user interface 20.

Figure 2:
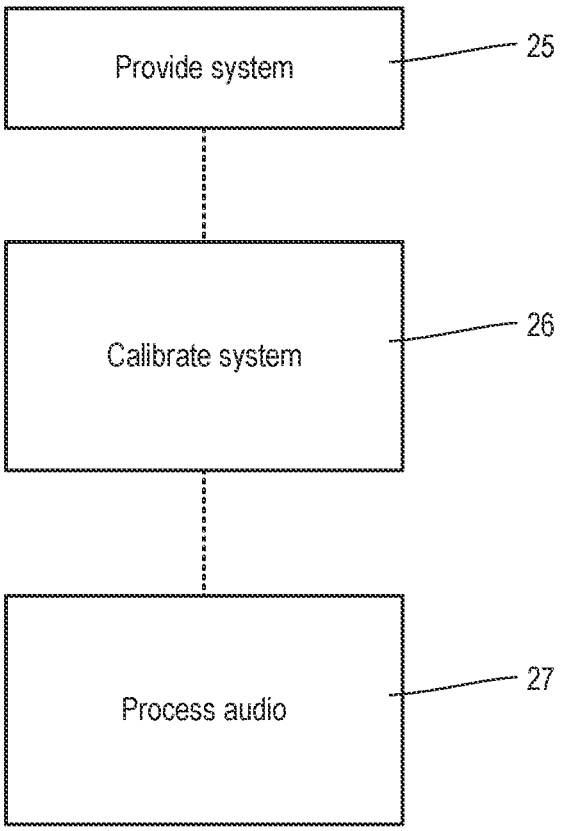
FIG. 2 shows a schematic representation of a process flow of a method for processing audio signals using the system of FIG. 1.

With reference to FIG. 2 the general method of processing audio signals with the system 1 is explained. The method can be stored on a non-transitory computer-readable medium and a processor or processors can access the non-transitory computer-readable medium to execute the method. The non-transitory computer-readable medium can be stored on one or multiple devices. In a provision step 25, the system 1 is provided. That is, in the provision step 25 the hearing device 2 and the secondary device 3 are provided. For example, the user U can purchase the hearing device 2 and install a corresponding app on his mobile phone. Alternatively, the user U may purchase the hearing device 2 together with a corresponding secondary device 3.

After the provision step 25, the system 1 is calibrated in a calibration step 26. In the calibration step 26, the calibration neural network 18 is used to calibrate the neural network 8 on the hearing device 2 as well as the secondary neural network 17 on the secondary device 3. Samples of the user's voice are recorded using the secondary recording unit 15. The secondary audio processing unit 16 calculates the Mel Frequency Cepstral Coefficients (MFCC) as well as two derivatives from the samples of the user's voice. The calibration neural network evaluates the calculated Mel Frequency Cepstral Coefficients and the derivatives 18 to calculate the user's speaker embedding. The calculated user's speaker embedding is provided to the secondary neural network 17. The calculated user's speaker embedding transferred to the hearing device 2, in particular the neural network 8, via the data connection 13.

The samples of the user's voice are recorded for a given amount of time, e.g. between 5 seconds and 30 minutes. For example, the samples may be recorded for about 3 minutes. The more samples, meaning the more time the samples are recorded, the more precise the calibration becomes. In the shown embodiment, the calibration is performed once, when the user U starts to use the system 1. In other embodiments, the calibration step 26 can also be repeated at later times, in order to gradually improve the user's speaker embedding and therefor the quality of the separation of the user voice signal u from the input signal I and the secondary input signal J respectively.

The calibrated system can be used for audio processing by the user in an audio processing step 27. In the audio processing step 27, the hearing device 2 is used to generate the output signal O which is played back to the user U. The system 1 provides different operation modes for the audio processing step 27. In the FIGS. 3 to 6, several different operation modes for the audio processing step 27 are described in detail.

Figure 3:
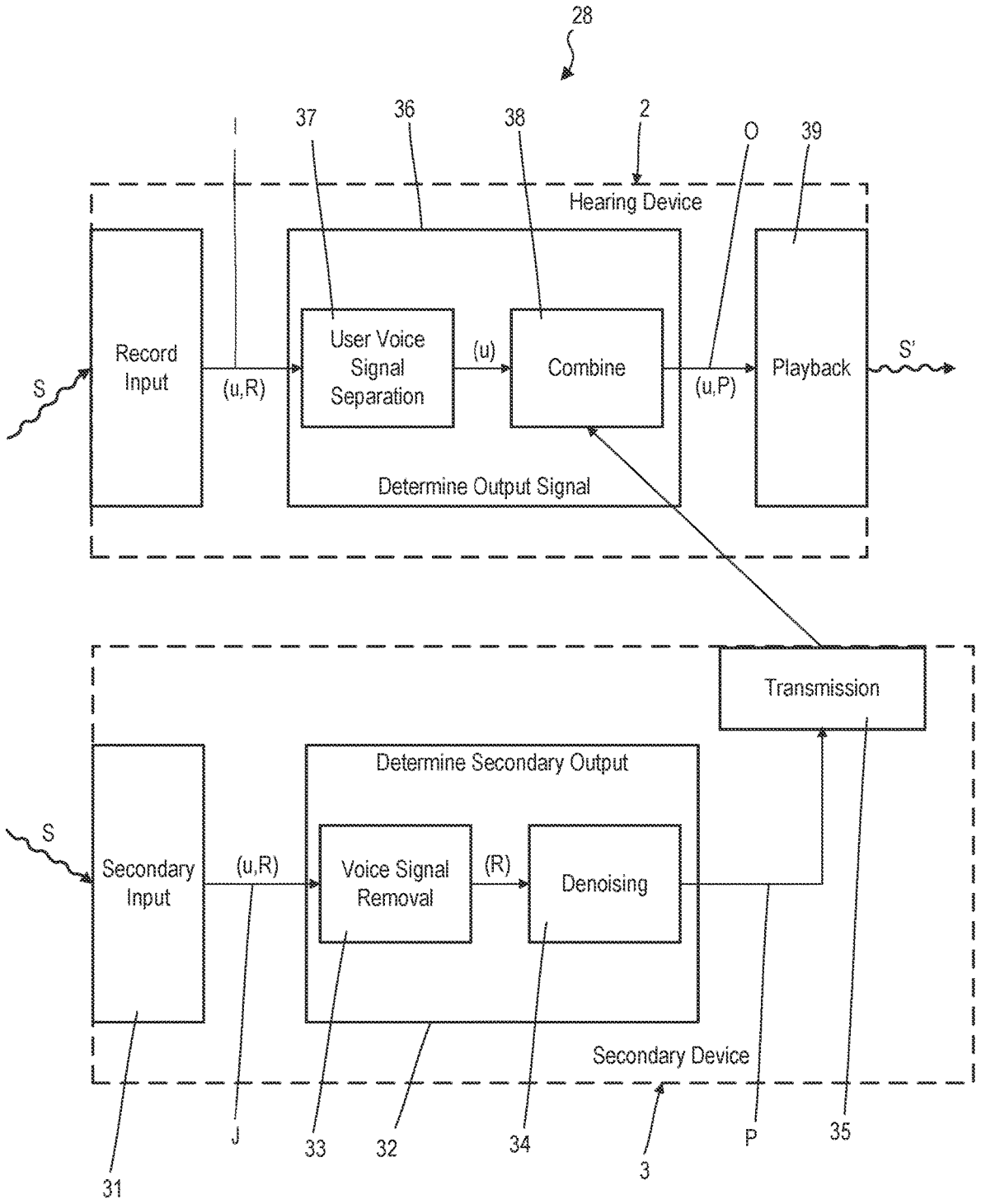
FIG. 3 shows a first operation mode for an audio processing step of the method of FIG. 2.

A first operation mode 28, which is shown in FIG. 3, involves the hearing device 2 and the secondary device 3. For sake of clarity, the hearing device 2 is shown as a broken line to surround all steps performed by the hearing device 2. Similarly, all steps performed by the secondary device 3 are enclosed by a broken line symbolizing the secondary device 3.

Suppose that the user is in a surrounding with the ambient sound S. The ambient sound S is recorded as the input signal I by the recording unit 5 of the hearing device 2 in an input recording step 30. The input signal I may comprise the user voice signal u and further audio signals marked with the letter R. The audio signals R are the relative complement of the user voice signal u in the input signal I: $R=I-u$. At the same time, the ambient sound S is recorded by the secondary recording unit 15 of the secondary device 3 in form of a secondary input signal J in a secondary input step 31. The secondary input signal J mainly coincides with the input signal I, e.g., it may contain the user voice signal u and the further audio signals R. The Possible differences between the input signal I and the secondary input signal J may be caused by the different positions of the recording unit 5 and the secondary recording unit 15 and/or their different recording quality.

In the following, the input signal I and the secondary input signal J are processed in parallel in the hearing device 2 and the secondary device 3. The secondary input signal J is passed to the secondary audio processing unit 16 for a secondary output signal determination step 32. In the secondary output signal determination step 32, the secondary neural network 17 removes the user voice signal u from the secondary input signal J in a user voice signal removal step 33. The remaining audio signals R are denoised in a denoising step 34 using the secondary neural network 17. In other embodiments, the user voice signal removal step 33 and the denoising step 34 can be executed in parallel by the secondary neural network 17. In further embodiments, the user voice signal removal step 33 and the denoising step 34 can be subsequently performed by two different secondary neural networks.

The denoised remaining audio signals are transmitted as the secondary output signal P to the secondary device 2 in a transmission step 35.

The audio processing unit step 6 of the hearing device 2 performs an output signal determination step 36. In the output signal determination step 36 the neural network 8 is used to separate the user signal u from the input signal I in a user voice signal separation step 37. After the user voice signal separation step 37, the user voice signal u is combined with the secondary output signal P which has been received from the secondary device 3 in a combination step 38. In the combination step 38, the user voice signal u and the denoised secondary output signal P can be mixed with varying amplitudes in order to adapt the output signal O to the preferences of the user U. The output signal O contains the user voice signal u and the secondary output signal P. The output signal O is transferred to the playback unit 7. The output signal O is played back to the user U in form of the processed sound S' in a playback step 39.

Since the user voice signal u and the secondary output signal P can be amplified before being combined, the user can choose how loud the user voice signal is in respect to the remaining audio signals R. In particular, the user can choose that the user voice signal u is not being played back to him.

In the above described operation mode 28 of audio processing step 27, the user voice signal u as well as the rest of the audio signals R are processed by neural networks, i.e. the neural network 8 and the secondary neural network 17, respectively. Processing the user voice signal u directly on the hearing device 2 has the advantage that the processed user voice signal u has not to be transferred from the secondary device 3 to the hearing device 2.

Hence, the user voice signal can be processed and played back to the user with low latency. Disturbing echoing effects, which occur when the user hears his own voice and the processed version of the own voice. At the same time the rest of the audio signals R are denoised using the secondary neural network 17 on the secondary device 3, which ensures optimum quality of the output signal O and the processed sound S'. Processing the rest of the audio signals R on the secondary device 3 requires transmitting the secondary output signal P from the secondary device 3 to the hearing device 2. This increases the latency, with which the rest of the audio signals R are played back to the user. However, the echoing effect is less pronounced for audio signals which do not correspond to the user's voice, the increased latency of the playback of the rest of the audio signals does not disturb the user.

In this regard, it is important to mention that the audio processing step 27 is a continuous process in which the input signal I and the secondary input signal J are permanently recorded and processed. Due to the lower latency of the processing of the user voice signal u, the processed user voice signal u is combined with a secondary output signal P which corresponds to audio signals R which have been recorded slightly earlier than the user voice signal u.

In total, the latency, with which the user voice signal u is played back to the user, is 50 ms or less, in particular 25 ms or less, in particular 20 ms or less, in particular 15 ms or less, in particular 10 ms or less.

In the operation mode 28 shown in FIG. 3 the user voice signal u is combined with the secondary output signal P from the secondary device 3. The audio processing unit does not process further audio signals. Hence, the classical audio signal processing means 9 are deactivated in the operation mode 28.

Figure 4:
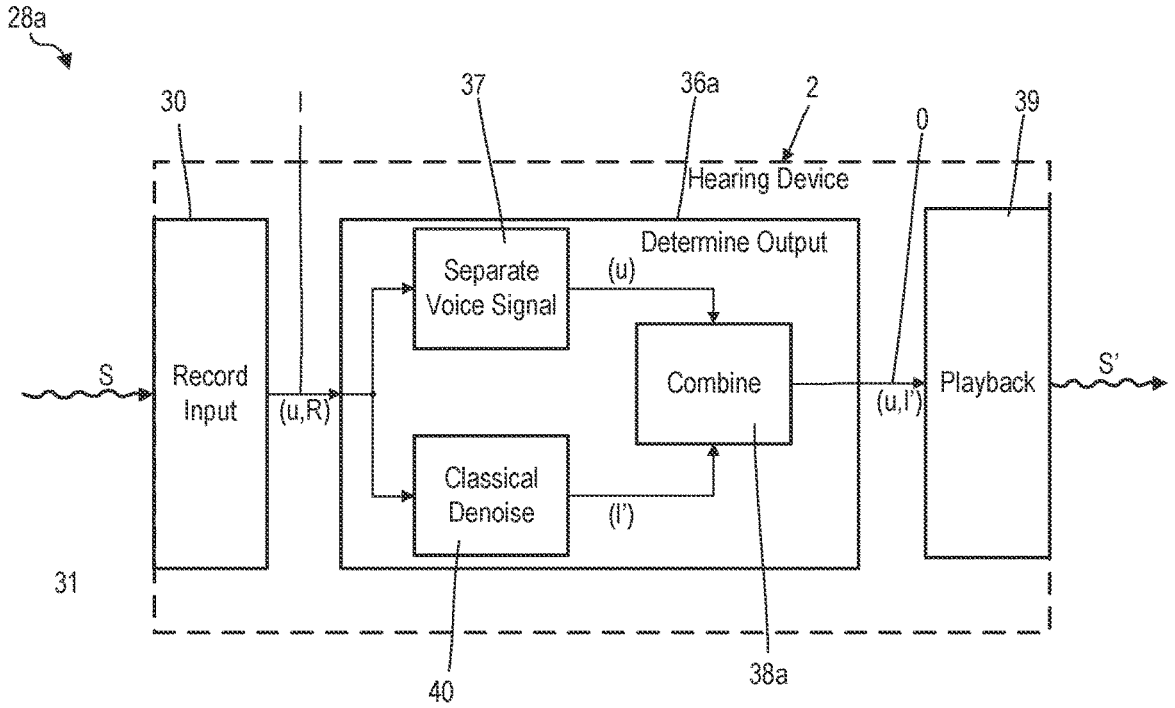
FIG. 4 shows an alternative operation mode for the audio processing step of the method of FIG. 2.
Figure 5:
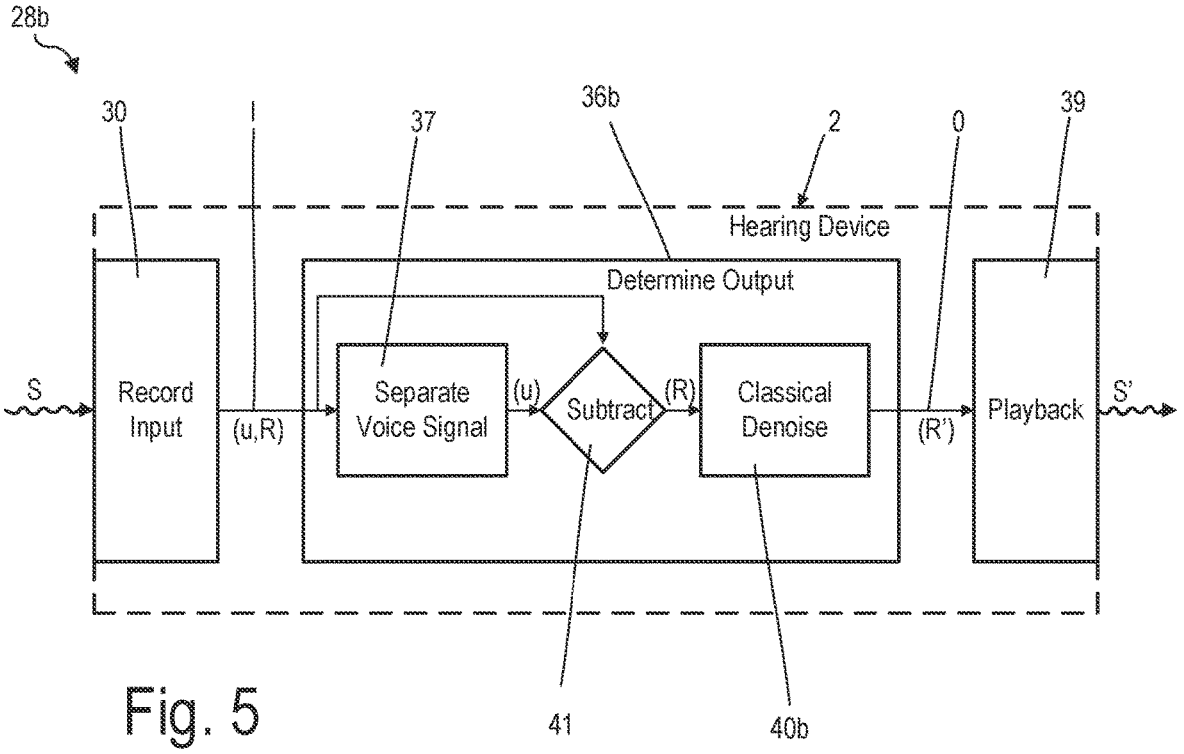
FIG. 5 shows a further alternative operation mode for the audio processing step of the method of FIG. 2.
Figure 6:
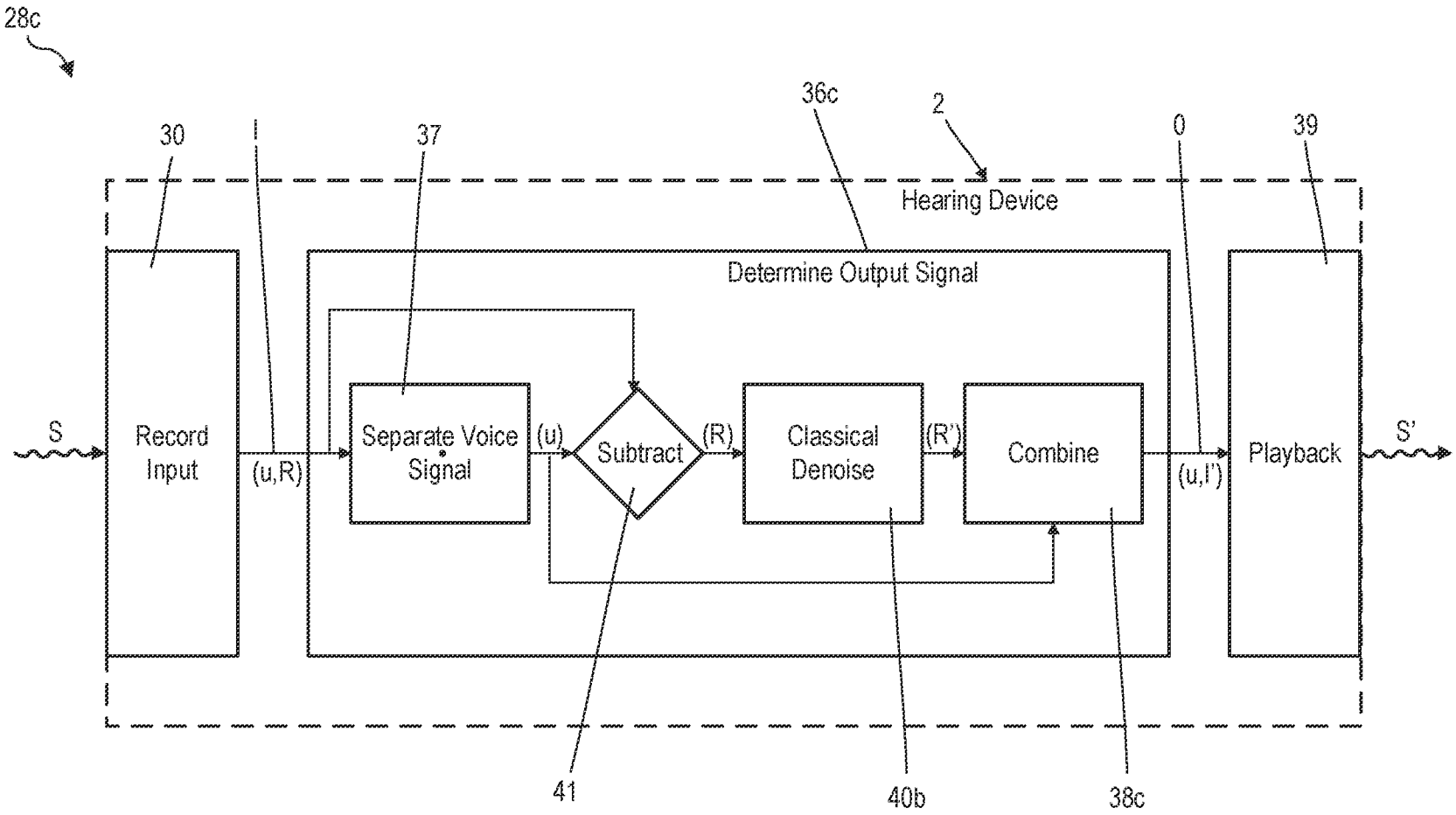
FIG. 6 shows a further alternative operation mode for the audio processing step of the method of FIG. 2.

With reference to FIGS. 4 to 6 alternative operation modes are described. In the alternative operation modes, the hearing device 2 determines the output signal O independent of the secondary device 3. These operation modes hence do not require the data connection 13. These operation modes can be used when the data connection 13 is lost. This is particularly advantageous, when the secondary device 3 is switched off or low on battery. Hence, the alternative operation modes can be used to save battery on the secondary device 3.

FIG. 4 shows an alternative operation mode 28*a* for the audio processing step 27. Components and steps which have already been discussed with reference to FIG. 3 have the same reference numbers and are not discussed in detail again. The operation mode 28*a* differs from the operation mode 28 shown in FIG. 3 in how the output signal O is determined by the audio processing unit 6 in the output determining step 36*a*.

In the output determining step 36*a* the input signal I is duplicated. One duplicate of the input signal I is processed in the user voice signal separation step 37 by the neural network 8. The user voice signal separation step 37 returns the user voice signal u in high quality. In parallel, a copy of the input signal I is classically denoised in a classical denoising step 40 using the classical audio signal processing means 9. The denoised input signal I' is combined with the user voice signal u in a combination step 38*a*. The output signal O hence contains the user voice signal u and the classically denoised input signal I'. In operation mode 28*a* the neural network 8 and the classical audio signal processing means 9 are run in parallel by the audio processing unit 6. However, the output signal O contains the high-quality user voice signal and the entire classically denoised input signal I' which itself contains the user voice signal u with less quality.

FIG. 5 shows an alternative operation mode 28*b* of the audio processing step 27. Components and steps which have already been discussed with reference to the FIG. 3 or 4 have the same reference numbers and are not discussed in detail again. Operation mode 28*b* only differs in the way how an output signal determination step 36*b* is performed from operation mode 28*a*. The input signal I is duplicated. In the user voice signal separation step 37 the user voice signal u is separated from one of the duplicates of the input signal I. In a subtraction step 41 the separated user voice signal u is subtracted from the other duplicate of the input signal I. The subtraction step returns the remaining audio signal R. The remaining audio signals R are then denoised in a classical denoising step 40*b* using the classical audio signal processing means 9. The denoised remaining audio signals R are forming the output signal O which is being played back to the user U. In operation mode 28*b* the user voice signal u is not played back the user U, which is particularly advantageous for people who can hear their own voice and do not need reproduction of their own voice by the hearing device 2. Using the neural network 8 it is guaranteed that the output signal O and the processed sound S' contain no fragments of the user voice signal u which might distract the user U.

In FIG. 6 a further alternative operation mode 28*c* for the audio processing step 27 is shown. Components and steps which have already been discussed with reference to one of the FIGS. 3 to 5 have the same reference numbers and are not discussed in detail again. The operation mode 28 of FIG. 6 only differs in the way the output signal O is determined in an output signal determining step 36*c* from the previously described operation modes. In the output signal determining step 36*c*, the input signal I is duplicated. The user voice signal u is separated from one duplicate of the input signal I via the user voice signal separation step 37. The user voice signal u obtained in the user voice signal separation step 37 is duplicated. One duplicate of the user voice signal u is subtracted from the input signal I in the subtraction step 41, resulting in the remaining audio signals R. The remaining audio signals R are classically denoised in the classical denoising step 40*b*. The denoised remaining audio signals R are combined in a combination step 38*c* with the user voice signal u. The resulting output signal O comprises the user voice signal u as well as the classically denoised remaining audio signals R. The operation mode 28*c* has the advantage that the user voice signal is played back to the user with high quality together with classically denoised audio signals.

In another operation mode, which is not shown in the figures, the output signal determination step 36 is performed without using the neural network 8. The neural network 8 may be temporarily deactivated, e.g., when the input signal I does not comprise the user voice signal u. In this use cases the neural network 8 is deactivated and the input signal I is simply processed by the classical audio signal processing means 9. This operation mode might be used to save energy, in particular when the charging state of the power supply 4 is low. This operation mode can also be used when the input signal I does not comprise the user voice signal u.

In a variant of the above-described operation modes, the output signal determination step comprises an additional pre-processing step for pre-processing the input signal I. In the preprocessing step the hearing device 2 can use sensor data of sensor 10 in order to measure whether the user voice signal u is present. To do so, the sensor 10 measures vibrations caused by the user speaking. Alternatively, the presence of the user voice signal u can be measured using the relative loudness of the user's voice in respect to other audio signals.

The different operation modes can be chosen by the user U, e.g., by a command input via the user interface 20. This way the user can choose whether he wants his own voice to be played back to him or not. Further, the user can choose with which quality the remaining audio signals R are denoised, in particular whether the remaining audio signals R are denoised using the secondary neural network 17 of the secondary device 3 or the classical audio signal processing means of the hearing device 2.

The system 3 can also automatically change between the different operation modes. For example, the hearing device 2 will automatically use one of the operation modes 28*a*, 28*b*, 28*c* discussed with reference to FIGS. 4 to 6 when the data connection 13 to the secondary device 3 is lost. Also, the secondary device 3 can trigger a change in the operation modes. For example, when the secondary input signal J does not contain a lot of noise, the denoising using the secondary neural network might not be needed. Hence, the secondary device 3 may monitor how much noise is found in the secondary input signal J. If the amount of noise is found to be low, the secondary device 3 may send a command to the hearing device 2 to switch to one of the operation modes which are shown in FIGS. 4 to 6. The command can be part of the secondary output signal P. The secondary device 3 may monitor the amount of noise in the secondary input signal J from time to time to evaluate whether the amount of noise has changed. If the amount of noise increases, the secondary device 3 may send a command to the hearing device 2 to initiate the operation mode 28 shown in FIG. 3.

In further embodiments which are not shown in the figures, the system comprises more than one hearing device, in particular two hearing devices.

The invention claimed is:

1. A hearing device comprising:

a recording unit for recording an input signal, an audio processing unit for determining an output signal, wherein the audio processing unit comprises a neural network for separating a user voice signal from the input signal, and a playback unit for playing back the output signal to a user.

2. The hearing device according to claim 1, wherein the audio processing unit further comprises a classical audio signal processing means for processing at least parts of the input signal to denoise the at least parts of the input signal.

3. The hearing device according to claim 2, wherein the classical audio signal processing means and the neural network are configured to be run at least one of in parallel or in series.

4. The hearing device according to claim 1, wherein the neural network is configured as a long short-term memory network with three layers.

5. The hearing device according to claim 1, further comprising: a voice detection unit for measuring a presence of a user voice signal in the input signal.

6. A system for processing audio signals, comprising:

a hearing device comprising an audio processing unit for determining an output signal, wherein the audio processing unit comprises a first neural network for separating a user voice signal from an input signal; and a secondary device, wherein the secondary device comprises a secondary audio processing unit for determining a secondary output signal, wherein the secondary audio processing unit comprises a secondary neural network for denoising, at least parts of a secondary input signal, wherein the secondary device configured to form a wireless data connection with the hearing device for at least one of transmitting at least parts of the secondary output signal to the hearing device or to receive the secondary input signal from the hearing device.

7. The system according to claim 6, wherein the secondary device comprises a secondary recording unit for recording the secondary input signal.

8. The system according to claim 6, wherein the secondary neural network is configured to separate the user voice signal from the secondary input signal.

9. The system according to claim 6, wherein the secondary audio processing unit comprises a calibration neural network for calibrating at least one of the first neural network or the secondary neural network.

10. The system according to claim 6, wherein the secondary device is a mobile device or a wireless microphone.

11. The system according to claim 6, wherein the wireless data connection is implemented using a BLUETOOTH protocol or using a proprietary protocol, wherein the proprietary protocol has a lower latency than BLUETOOTH.

12. A method for processing audio signals, the method comprising:

recording an input signal using a recoding unit;

determining an output signal using an audio processing unit;

wherein a user voice signal is separated from the input signal by a neural network; and providing the output signal to a user using a hearing device.

13. The method according to claim 12, wherein the determining the output signal comprises denoising at least parts of the input signal by a classical audio signal processing means.

14. The method according to claim 12, wherein at least parts of the input signal are denoised by a classical audio signal processing means in parallel to the separation of the user voice signal by the neural network.

15. The method according to claim 12, wherein at least parts of the input signal are processed denoised by a classical audio signal processing means after the user voice signal is separated from the input signal by the neural network.

16. The method according to claim 12, wherein the neural network is a first neural network, further comprising:

determining a secondary output signal by denoising at least parts of a secondary input signal using a secondary neural network, and transmitting at least parts of the secondary output signal to the hearing device.

17. The method according to claim 16, wherein denoising of the secondary input signal by the secondary neural network comprises separating the user voice signal from the secondary input signal.

18. The method according to claim 16, wherein the secondary output signal is at least partially included in the output signal by the audio processing unit of the hearing device.

19. The method according to claim 16, further comprising calibrating at least one of the first neural network or the secondary neural network using a calibration neural network that is part of a secondary audio processing unit.

20. The method according to claim 19, wherein a calibration input signal is provided to and analyzed by the calibration neural network.

* * * * *